US009121111B2

(12) United States Patent
Turner et al.

(10) Patent No.: US 9,121,111 B2
(45) Date of Patent: Sep. 1, 2015

(54) PROCESS FOR THE MANUFACTURE OF CELLULOSE-BASED FIBERS

(75) Inventors: Philip Turner, Edinburgh (GB); Zurine Hernandez, Edinburgh (GB); Callum Hill, Edinburgh (GB)

(73) Assignee: SAPPI Netherlands Services B.V., Maastricht (NL)

( * ) Notice: Subject to any disclaimer, the term of this patent is extended or adjusted under 35 U.S.C. 154(b) by 1144 days.

(21) Appl. No.: 13/124,343

(22) PCT Filed: Oct. 9, 2009

(86) PCT No.: PCT/GB2009/051356
§ 371 (c)(1),
(2), (4) Date: Jul. 7, 2011

(87) PCT Pub. No.: WO2010/043889
PCT Pub. Date: Apr. 22, 2010

(65) Prior Publication Data

US 2011/0263840 A1 Oct. 27, 2011

(30) Foreign Application Priority Data

Oct. 14, 2008 (GB) ..... 0818763.5
Feb. 27, 2009 (GB) ..... 0903378.8

(51) Int. Cl.

| | |
|---|---|
| ***D01D 5/04*** | (2006.01) |
| ***D01F 2/00*** | (2006.01) |
| ***D01F 2/30*** | (2006.01) |
| ***D01F 2/24*** | (2006.01) |
| ***D01D 5/12*** | (2006.01) |

(52) U.S. Cl.
CPC .. *D01F 2/00* (2013.01); *D01D 5/12* (2013.01); *D01F 2/24* (2013.01); *D01F 2/30* (2013.01)

(58) Field of Classification Search
CPC ..... D01D 5/04; D01F 2/24; D01F 2/30
USPC ..... 264/207, 208
See application file for complete search history.

(56) References Cited

U.S. PATENT DOCUMENTS

| | | | | |
|---|---|---|---|---|
| 3,357,845 | A | 12/1967 | Battista | |
| 4,750,939 | A | 6/1988 | Cuculo et al. | |
| 5,365,775 | A * | 11/1994 | Penniman | 73/53.04 |
| 6,153,136 | A | 11/2000 | Collier et al. | |
| 6,967,027 | B1 * | 11/2005 | Heux et al. | 424/488 |
| 2002/0153076 | A1 | 10/2002 | Meraldi et al. | |
| 2008/0146701 | A1 * | 6/2008 | Sain et al. | 524/9 |
| 2008/0154225 | A1 * | 6/2008 | Phan | 604/367 |
| 2009/0192264 | A1 | 7/2009 | Laborie et al. | |

FOREIGN PATENT DOCUMENTS

| | | |
|---|---|---|
| GB | 1 322 723 A | 7/1973 |
| JP | S41-015318 | 7/1966 |
| JP | H07-102073 A | 4/1995 |
| JP | H11-209401 A | 8/1999 |

OTHER PUBLICATIONS

A. Thygesen, et al., "On the determination of crystallinity and cellulose content in plant fibres," Cellulose, 2005, pp. 563-576, vol. 12, No. 6, Kluwer Academic Publishers.
J. Araki, et al., "Effect of Trace Electrolyte on Liquid Crystal Type of Cellulose Microcrystals," Langmuir, 2001, pp. 4493-4496, vol. 17, No. 15.
G.K. Batchelor, "The stress generated in a non-dilute suspension of elongated particles by pure straining motion," J. Fluid Mech., 1971, pp. 813-829, vol. 46, Part 4.
F. Kimura, et al., "Magnetic Alignment of the Chiral Nematic Phase of a Cellulose Microfibril Suspension," Langmuir, 2005, pp. 2034-2037, vol. 21, No. 5.
W. Song, et al., "Isotropic-Nematic Phase Transition of Dispersions of Multiwall Carbon Nanotubes," Macromolecules, 2005, pp. 6181-6188, vol. 38.
Q. Dai, et al., "Transient rheological behavior of lyotrophic (acetyl)(ethyl)cellulose/*m*-cresol solutions," Cellulose, 2006, pp. 213-223, vol. 13.

* cited by examiner

*Primary Examiner* — Leo B Tentoni
(74) *Attorney, Agent, or Firm* — Sughrue Mion, PLLC

(57) ABSTRACT

A method for the spinning of a fiber comprising cellulose nano-fibrils being aligned along the main axis of the fiber from a lyotropic suspension of cellulose nano-fibrils, said nano-fibril alignment being achieved through extension of the extruded fiber from a die, spinneret or needle, wherein said fiber is dried under extension and the aligned nano-fibrils aggregate to form a continuous structure. The fibrils used in this method can be extracted from a cellulose-rich material such as wood. The invention also related to a cellulose-based fiber obtained according to this method and to a cellulose fiber which contains at least 90% wt of crystallized cellulose.

19 Claims, 15 Drawing Sheets

W_13-2 3.0kV 6.2mm x25.0k SE(U) 2.00um

P_13-3 3.0kV 6.8mm x25.0k SE(U) 2.00um

FP_Fibre_1 3.0kV 6.4mm x1.00k SE(U) 50.0um

FP_Fibre_1 3.0kV 6.5mm x5.00k SE(U) 10.0um

PROCESS FOR THE MANUFACTURE OF CELLULOSE-BASED FIBERS

CROSS REFERENCE TO RELATED APPLICATIONS

This application is a National Stage of International Application No. PCT/GB2009/051356 filed Oct. 9, 2009, claiming priority based on Great Britain Patent Application No. 0818763.5 filed Oct. 14, 2008 and Great Britain Patent Application No. 0903378.8 filed Feb. 27, 2009, the contents of all of which are incorporated herein by reference in their entirety.

FIELD OF THE INVENTION

The invention relates to the manufacture of fibres using cellulose nano-fibrils, in particular cellulose nano-fibrils extracted from cellulose material such as wood pulp.

BACKGROUND OF THE INVENTION

Cellulose is a straight-chain polymer of anhydroglucose with β 1-4 bonds. A great variety of natural materials comprise a high concentration of cellulose. Cellulose fibres in natural form comprise such material as cotton and hemp. Synthetic cellulose fibres comprise products such as rayon (or viscose) and a high strength fibre such as lyocell (marketed under the name TENCEL™).

Natural cellulose exists in either an amorphous or crystalline form. During the manufacture of synthetic cellulose fibres the cellulose is first transformed into amorphous cellulose. As the strength of the cellulose fibres is dependent upon the presence and the orientation of cellulose crystals, the cellulose material can then be re-crystallised during the coagulation process to form a material provided with a given proportion of crystallised cellulose. Such fibres still contain a high amount of amorphous cellulose. It would therefore be highly desirable to design a process to obtain cellulose-based fibres having a high content of crystallised cellulose.

The crystallised form of cellulose which can be found in wood, together with other cellulose based material of natural origin, comprises high strength crystalline cellulose aggregates which contribute to the stiffness and strength of the natural material and are known as nano-fibres or nano-fibrils. These crystalline nano-fibrils have a high strength to weight ratio which is approximately twice that of Kevlar but, at present, the full strength potential is inaccessible unless these fibrils can be fused into much larger crystalline units. These nano-fibrils, when isolated from the plant or wood cell can have a high aspect ratio and can form lyotropic suspensions under the right conditions.

Song, W., Windle, A. (2005) "Isotropic-nematic phase transition of dispersions of multiwall carbon nanotube" published in Macromolecules, 38, 6181-6188 described the spinning of continuous fibres from a liquid crystal suspension of carbon nanotubes which readily form a nematic phase (long range orientational order along a single axis). The nematic structure permits good inter-particle bonding within the fibre. However natural cellulose nano-fibrils, once extracted from their natural material, generally form a chiral nematic phase (a periodically twisted nematic structure) when the concentration of nano-fibrils is above about 5-8% and would therefore prevent the nano-fibrils from completely orienting along the main axis of a spun fibre. Twists in the nano-fibril structure will lead to inherent defects in the fibre structure.

In the article "Effect of trace electrolyte on liquid crystal type of cellulose micro crystals", *Longmuir*; (Letter); 17(15); 4493-4496, (2001) Araki, J. and Kuga, S. demonstrated that bacterial cellulose can form a nematic phase in a static suspension after around 7 days. However, this approach would not be practical for the manufacture of fibres on an industrial basis and is specifically related to bacterial cellulose which is difficult and costly to obtain.

Kimura et al (2005) "Magnetic alignment of the chiral nematic phase of a cellulose microfibril suspension" *Langmuir* 21, 2034-2037 reported the unwinding of the chiral twist in a cellulose nano-fibril suspension using a rotating magnetic field (5 T for 15 hours) to form a nematic like alignment. This process would not however be usable in practice to form a usable fibre on an industrial level.

Work by Qizhou et al (2006) "Transient rheological behaviour of lyotropic (acetyl)(ethyl) cellulose/m-cresol solutions, *Cellulose* 13:213-223, indicated that when shear forces are high enough, the cellulose nano-fibrils in suspension will orient along the shear direction. The chiral nematic structure changes to a flow-aligned nematic-like phase. However, it was noted that chiral nematic domains remain dispersed within the suspension. No mention was made relating to practical applications of the phenomena such as the formation of continuous fibres.

Work by Batchelor, G. (1971) "The stress generated in a non-dilute suspension of elongated particles in pure straining motion", *Journal of Fluid Mechanics,* 46, 813-829, explored the use of extensional rheology to align a suspension of rod-like particles (in this case, glass fibres). It was shown that an increase in concentration, but especially an increase in aspect ratio of the rod-like particles results in an increase in elongational viscosity. No mention was made of the potential for unwinding chiral nematic structures present in liquid crystal suspensions.

British patent GB1322723, filed in 1969 describes the manufacture of fibres using "fibrils". The patent focuses primarily on inorganic fibrils such as silica and asbestos but a mention is made of microcrystalline cellulose as a possible, albeit hypothetical, alternative.

Microcrystalline cellulose is a much coarser particle size than the cellulose nano-fibrils. It typically consists of incompletely hydrolyzed cellulose taking the form of aggregates of nano-fibrils which do not readily form lyotropic suspensions. Microcrystalline cellulose is also usually manufactured using hydrochloric acid resulting in no surface charge on the nano-fibrils.

GB 1322723 generally describes that fibres can be spun from suspension which contains fibrils. However the suspensions used in GB 1322723 have a solids content of 3% or less. Such solids content is too low for any draw down to take place. Indeed, GB 1322723 teaches to add a substantial amount of thickener to the suspensions. It should be noted that the use of a thickener would prevent the formation of a lyotropic suspension and interfere with the interfibril hydrogen bonding that is desirable for achieving high fibre strength.

Also a 1-3% suspension of cellulose nano-fibrils, particularly one containing a thickener, would form an isotropic phase. GB 1322723 does not deals with the problems associated with using concentrated suspension of fibrils, and in particular using suspensions of fibrils which are lyotropic.

SUMMARY OF THE INVENTION

It is now provided a method which can be used to manufacture highly crystallised cellulose fibres using, in particular, naturally occurring crystallised cellulose.

The present invention is directed to a method for the manufacture of cellulose based fibres, in particular a continuous fibre, which comprises the steps of spinning of a continuous fibre from a lyotropic suspension of cellulose nano-fibrils, wherein said fibre comprises cellulose nano-fibrils aligned along the main axis of the fibre, said nano-fibril alignment being achieved through extension of the extruded fibre from a die or needle and wherein said fibre is dried under extension and the aligned nano-fibrils aggregate form a continuous structure.

The invention is further directed to a cellulose-based fibre which contains crystallised cellulose to a high degree and may be obtained by the method of the invention. According to a much preferred embodiment of the invention the fibre comprises a highly aligned or continuous microstructure which provides said fibre with high strength.

Extraction of the Nano Fibrils

It is highly preferred that the cellulose nano-fibrils used in the invention be extracted from a cellulose rich material.

All natural cellulose-based material which contains nano-fibrils, such as wood pulp or cotton, can be considered as starting material for this invention. Wood pulp is preferred as being cost effective but other cellulose-rich material can be used such as chitin, hemp or bacterial cellulose.

Extraction of the nano-fibrils may most typically involve the hydrolysis of the cellulose source which is preferably ground to a fine powder or suspension.

Most typically the extraction process involves hydrolysis with an acid such as sulphuric acid. Sulphuric acid is particularly suitable since, during the hydrolysis process, charged sulphate groups are deposited on the surface of the nano-fibrils. The surface charge on the surface of the nano-fibrils creates repulsive forces between the fibres, which prevents them from hydrogen bonding together (aggregating) in suspension. As a result they can slide freely amongst each other. It is this repulsive force combined with the aspect ratio of the nano-fibrils, which leads to the highly desirable formation of a chiral nematic liquid crystal phase at a high enough concentration. The pitch of this chiral nematic liquid crystal phase is determined by fibril characteristics including aspect ratio, polydispersity and level of surface charge.

Alternative methods of nano-fibril extraction could be used but a surface charge should have to be applied to the nano-fibrils to favour their spinning into a continuous fibre. If the surface charge is insufficient to keep the nano-fibrils apart during the initial part of the spinning process, (before drying), the nano-fibrils may aggregate together and eventually prevent the flow of the suspension during spinning.

Once the hydrolysis has taken place, at least one nano-fibril fractionation step is preferably carried out, for example by centrifugation, to remove fibrilar debris and water to produce a concentrated cellulose gel or suspension.

In order to remove as much of amorphous cellulose and/or fibrilar debris as possible, subsequent washing steps may optionally take place. These washing steps may be carried out with a suitable organic solvent but is advantageously carried out with water, preferably with de-ionised water, and are followed by a separating step, usually carried out by centrifugation, to remove fibrilar debris and water as water removal is required to concentrate the nano fibrils. Three successive washing and subsequent centrifugation steps have provided suitable results.

Alternatively or additionally the nano-fibrils can be separated using phase behaviour of the suspension. At a critical concentration, typically around 5 to 8% cellulose, a biphasic region is obtained, one being isotropic, the other being anisotropic. These phases separate according to aspect ratio. The higher aspect ratio of the fibres forms the anisotropic phase and can be separated from the amorphous cellulose and/or fibrilar debris. The relative proportion of these two phases depends upon the concentration, the level of surface charge and the ionic content of the suspension. This method alleviates and/or suppresses the need for centrifugation and/or washing steps to be carried out. This method of fractionation is therefore simpler and more cost effective and is therefore preferred.

According to a particular embodiment of the invention it has been found advantageous to adjust the Zeta potential of the suspension using, for example, dialysis. Zeta potential can range from −20 mV to −60 mV but is advantageously adjusted to range from −25 mV to −40 mV, preferably from −28 mV to −38 mV and even more preferably from −30 mV to −35 mV. To do so the hydrolysed cellulose suspension mixed with deionised water can be dialysed against deionised water using, for example, Visking dialysis tubing with a molecular weight cut-off ranging preferably from 12,000 to 14,000 Daltons. The dialysis is used to increase and stabilise the Zeta potential of the suspension from around −50 to −60 mV to preferably between −30 mV and −33 mV (see FIG. 20).

This step is particularly advantageous when sulphuric acid has been used for carrying out the hydrolysis.

The zeta potential was determined using a Malvern Zetasizer Nano ZS system. A Zeta potential lower than −30 mV results is an unstable suspension at high concentration with aggregation of nano-fibrils taking place which can lead to an interruption in the flow of the suspension during spinning. A Zeta potential above −35 mV leads to poor cohesion in the fibre during spinning, even at high solids concentrations of above 40%.

Pressurised dialysis equipment could be used to speed up this process.

As an alternative, the suspensions can be taken out of dialysis at an earlier time (e.g. 3 days) and subsequently treated with heat (to remove some of the sulphate groups) or a counterion (such as calcium chloride) to reduce the zeta potential to the required level.

The nano-fibril suspension may comprise an organic solvent. However it is preferred that said suspension be water-based. Thus, the solvent or liquid phase of the suspension may be at least 90% wt water, preferably at least 95% wt, and even preferably 98% wt water.

According to another embodiment of the invention, the cellulose suspension is advantageously homogenised before spinning to disperse any aggregates. Sonication can be used, for example in two 10 minute bursts to avoid overheating.

To obtain the most suitable cellulose suspension for the spinning step the homogenised cellulose suspension can then re-centrifuged to produce the concentrated, high viscosity suspension particularly suitable for spinning.

According to a preferred aspect of the invention the cellulose suspension to be used in the spinning of the fibre is a lyotropic suspension (i.e. a chiral nematic liquid crystal phase). Once the chiral twist from such a cellulose suspension has been unwound, it permits the formation of a highly aligned microstructure, which is desirable to obtain high strength fibres.

In the process of the invention, the viscosity of the suspension required for spinning (i.e. its concentration of solids and nano-fibril aspect ratio) may vary depending upon several factors. For example it may depend upon the distance between the extrusion point and the point at which the chiral structure of the fibre is unwound and then dried. A larger distance means that the wet strength, and therefore the viscosity, of the suspension have to be increased. The level of concentrated solids may range from 10 to 60% wt. However it is preferable to use suspensions having a high viscosity and a solid content percentage chosen from 20-50% wt, and more preferably of about 30-40% wt. The viscosity of the suspension can be higher than 5000 poise. At these preferred concentrations the use of thickeners is not desirable. In any case the minimum concentration of solids should be above the level at which a bi-phasic region (where isotropic and anisotropic phases are present simultaneously, in different layers) occurs. This would normally be above 4% wt. but more typically above 6-10% wt. depending on the aspect ratio of nano-fibrils and the ionic strength of the solution. FIG. 21 gives an example of the volume fraction of the anisotropic phase in relation to cellulose concentration of cotton based cellulose nano-fibrils.

Spinning the Suspension into a Fibre

Accordingly, a particularly preferred embodiment of the method of the invention is carried out with a cellulose suspension in a chiral nematic phase and the spinning characteristics are defined such as to unwind the chiral nematic structure into a nematic phase to allow the subsequent formation at an industrial level of a continuous fibre in which the nano-fibrils aggregate together into larger crystalline structures.

To spin the cellulose suspension into fibres, the cellulose suspension of nano fibrils is first forced through a needle, a die or a spinneret. The fibre passes through an air gap to a take up roller where it is stretched and the nano-fibrils are forced into alignment under the extensional forces whilst the fibre dries. The level of extensional alignment is due to the velocity of the take up roller being higher than the velocity of the fibre as it exits the die. The ratio of these two velocities is referred to as the draw down ratio (DDR). The alignment of said nano-fibres is advantageously improved by the use of a hyperbolic dye designed to match the rheological properties of the suspension. The design of such dies is well documented in the public domain.

If the fibre is stretched and drawn down sufficiently then inter-fibril bonding will be sufficient to form a large crystalline unit. By large crystalline unit it is meant crystallised aggregates ranging from 0.5 microns in diameter, preferably up to the diameter of the fibre. The preferred size of fibres will be in the range of 1 to 10 microns. Although fibres of up to 500 microns or larger could be spun, it is unlikely that the size of the crystalline unit would exceed 5-10 microns. It is anticipated that fibres in the region of 1 to 10 microns would exhibit larger crystalline units and fewer crystalline defects and therefore higher strength. Larger crystalline structures are formed as draw down is increased and stronger fibres will result from the use of higher draw down ratios (DDR).

Preferably DDR are chosen to be superior to 1.2, advantageously 2. More advantageously the DDR is above 3. A draw down ratio chosen in the range of 2 to 20 is preferred to obtain fibres having large crystalline units (above 1 micron). Draw down ratios above this may be required to achieve larger aggregation. Draw down ratios of over 5000 may be used if smaller diameter fibres are required from large initial fibre diameters such as a reduction from 240 microns to 1 micron. However, such large draw down ratios are not necessarily required to achieve the aggregation that is required.

Drying Step

It is desirable that most of the water or solvent contained in the newly formed fibres as extruded through the die should be removed during, spinning. The removal of the liquid phase—or drying—can take a number of forms. The preferred approach uses heat to directly remove the liquid phase. For example the fibre can be spun onto a heated drum to achieve drying or can be dried using a flow of hot air, or radiant heat, applied to the fibre after its extrusion and, preferably, before it reaches the drum or take up wheel.

An alternative approach would be to pass the wet fibre through a coagulation bath to remove the majority of the water after which it could then be dried further through heating.

During the drying step the spun fibre is stretched and the chiral nematic structure within the suspension is unwound so that the nano-fibrils are oriented along the axis of the fibre in a nematic phase. As the fibre begins to dry, the nano-fibrils move more closely together and hydrogen bonds are formed to create larger crystalline units within the fibre, maintaining the nematic formation in the solid state.

It should be noted that according to a preferred embodiment of the invention the only additives to the suspension in addition to water are counter ions directed to control the surface charge of the fibres such as sulphate group.

Fibre

The fibre according to the invention preferably contains at least 90% wt, advantageously at least 95% and more preferably above 99% of crystallised cellulose. According a variant of the invention the fibre is constituted of crystallised cellulose. A standard analytical method involving the use of, for example, Solid State NMR or X-Ray diffraction could be used to determine the relative proportion of crystalline and amorphous material.

According to a preferred embodiment of the invention, only trace amounts of amorphous cellulose (less than about 1% wt) are present at the surface or in the core of the fibre.

According to another preferred embodiment the fibre comprises micro-crystals which are highly aligned in the axial direction of the fibre. By "highly aligned" it is meant that above 95%, preferably more than 99%, of the micro crystals are aligned within the axial direction. Levels of alignment can be determined through assessment of electron microscopy images. It is further preferred that the fibre be made of such (a) micro crystal(s).

It is further preferred that the fibre according to the present invention is of high tensile strength, above at least 20 cN/tex, but more preferably in the range of 50 to 200 cN/tex.

According to the invention, the fibre may have a linear mass density, as calculated according to industry standards for industrial synthetic fibres such as Kevlar and carbon fibre, ranging from 0.05 to 20 Tex. Typically such fibres may have an linear mass density of around 0.5 to 1.5.

According to a further embodiment the fibre is obtained using the method of the invention described within the present specification.

According to a particularly preferred embodiment of the invention, the process does not involve the use of organic solvents at least during the spinning step. This feature is particularly advantageous as the absence of organic solvent is not only economically profitable but also environmentally friendly. Thus, according to a feature of the invention, the whole process can be water-based, as the suspension used for spinning the fibre can be substantially water based. By "substantially water based" it is meant that at least 90% by weight of the solvent use in the suspension is water. The use of a water-based suspension during the spinning process is particularly desirable because of its low toxicity, low cost, ease of handling and benefits to the environment.

BRIEF DESCRIPTION OF THE DRAWINGS

In order that the invention be more readily understood and put into practical effect, reference will now be made to the accompanying figures which illustrate some aspects of some embodiments of the invention.

EXAMPLE 1

Figure 1:
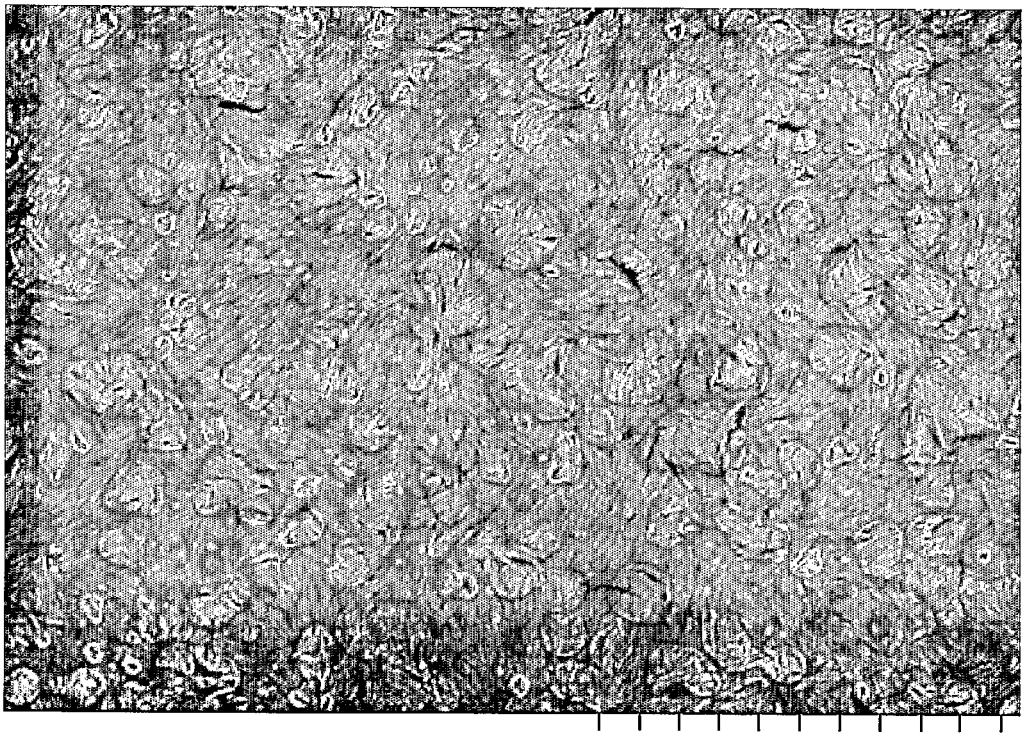
FIG. 1: is a FEG-SEM image of cellulose gel after hydrolysis and extraction by centrifugation.

Cellulose Nano Fibril Extraction and Preparation Process

The source of cellulose nano fibrils used in the example has been filter paper, and more particularly Whatman no 4 cellulose filter paper. Of course experimental conditions may vary for different sources of cellulose nano-fibrils.

The filter paper is cut into small pieces and then ball-milled to a powder that can pass a size 20 mesh (0.841 mm).

The powder obtained from ball milling is hydrolysed using sulphuric acid as follows:

Cellulose powder at a concentration of 10% (w/w) is hydrolysed using 52.5% sulphuric acid at a temperature of 46° C. for 75 minutes with constant stirring (using a hotplate/magnetic stirrer). After the hydrolysis period ends the reaction is quenched by adding excess de-ionised water equal to 10 times the hydrolysis volume.

The hydrolysis suspension is concentrated by centrifugation at a relative centrifugal force (RCF) value of 17,000 for 1 hour. The concentrated cellulose is then washed 3 additional times and re-diluted after each wash using deionised water followed by centrifugation (RCF value −17,000) for 1 hour. The following example illustrates the benefits of washing and repeated centrifugation resulting in fractionation with the subsequent removal of fibrilar debris.

EXAMPLE 2

Washing and Fractionation Study

Pictures of the concentrated suspension in one hand and the wash water have been obtained using Field Emission Gun-Scanning Emission Microscope (FEG-SEM) to show the impact of centrifugation on fractionation of the nano-fibril suspensions. Following hydrolysis and extraction three additional washes were carried out. All images reproduced in this study are shown at 25000× magnification.

Hydrolysis and Extraction

The standard hydrolysis process was used on ball milled (Whatman N.4) filter paper (52.5% sulphuric acid concentration, 46° C. and 75 min).

After hydrolysis of 30 grams of ball milled filter paper the diluted nano-fibril suspension was separated into 6 500 ml bottles, which were placed in the centrifuge. The first wash runs for one hour at 9000 rpm. (17000 G). After this time two different phases were obtained, an acidic solution product from hydrolysis (wash water) and a concentrated cellulose gel pellet (20% cellulose).

FIG. 1 shows a FEG-SEM image of the structure of the gel formed after the first wash. The structure of individual cellulose nano-fibrils can be seen with a strong domain structure. However, it is quite difficult to discriminate individual fibrils. This is thought to be due to the presence of amorphous cellulose and fine debris.

Figure 2:
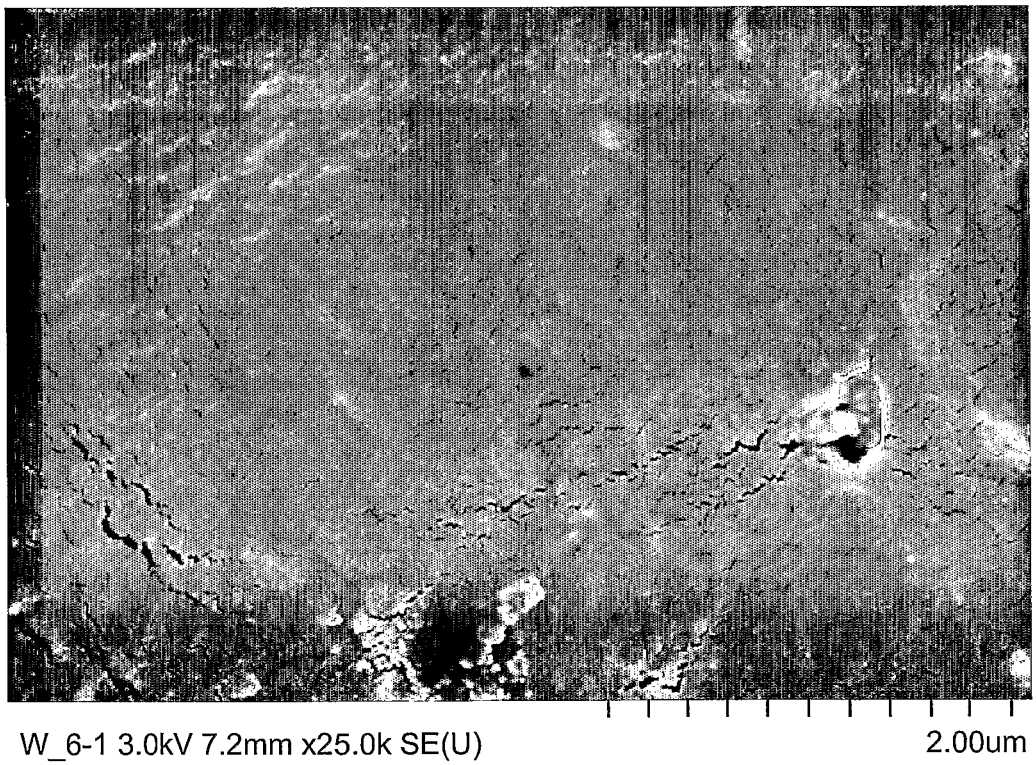
FIG. 2: is a FEG-SEM image of wash water after the hydrolysis and extraction by centrifugation.

FIG. 2 shows a FEG-SEM image of the remaining acidic solution. It is not possible to identify individual cellulose nano-fibrils. Some structure can be seen in the image but this is clouded by what is thought to be largely amorphous cellulose and fibrilar debris that is too small to discriminate at this magnification.

1st Wash

Figure 3:
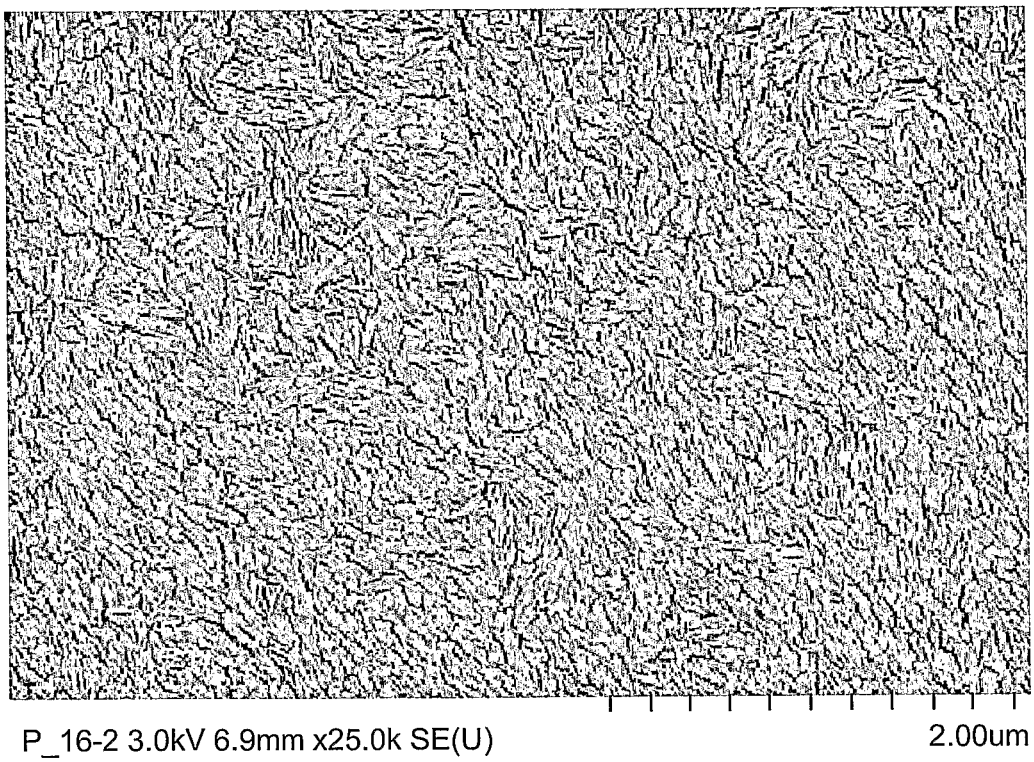
FIG. 3: is a FEG-SEM image of cellulose gel pellet after the first wash.
Figure 4:
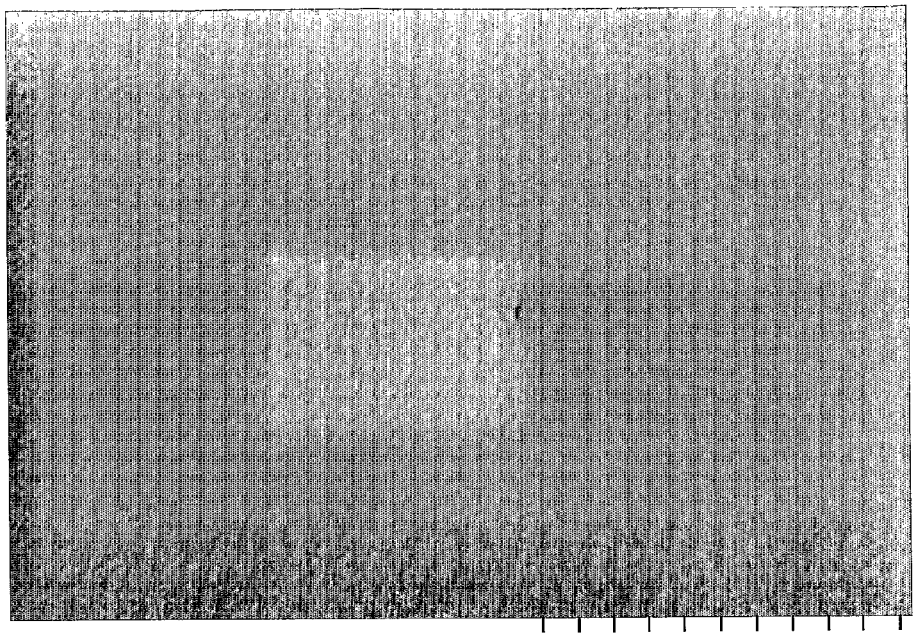
FIG. 4: is a FEG-SEM image of wash water after the first wash.

The gel pellet was dispersed in 250 ml of de-ionized water for further cleaning in this and subsequent washes. The solution was spun in the centrifuge for one hour and the cellulose gel pellet and wash water re-evaluated. FIG. 3 shows the structure of the cellulose gel after the first wash. The cellulose nano-fibril structure is clearer than after the first extraction. It is thought that this is due to the extraction of much of the amorphous cellulose and fine fibrilar debris during the second centrifugation. FIG. 4 shows an image of the wash water after the first wash. It looks comparable to that of FIG. 2 and is still thought to comprise primarily of amorphous cellulose and fine fibrilar debris. The amorphous character of the material was supported by the fact that it is highly unstable under the electron beam. It was extremely difficult to capture an image before it is destroyed. This problem was not observed to the same degree with the crystalline nano-fibrils.

2nd Wash

Figure 5:
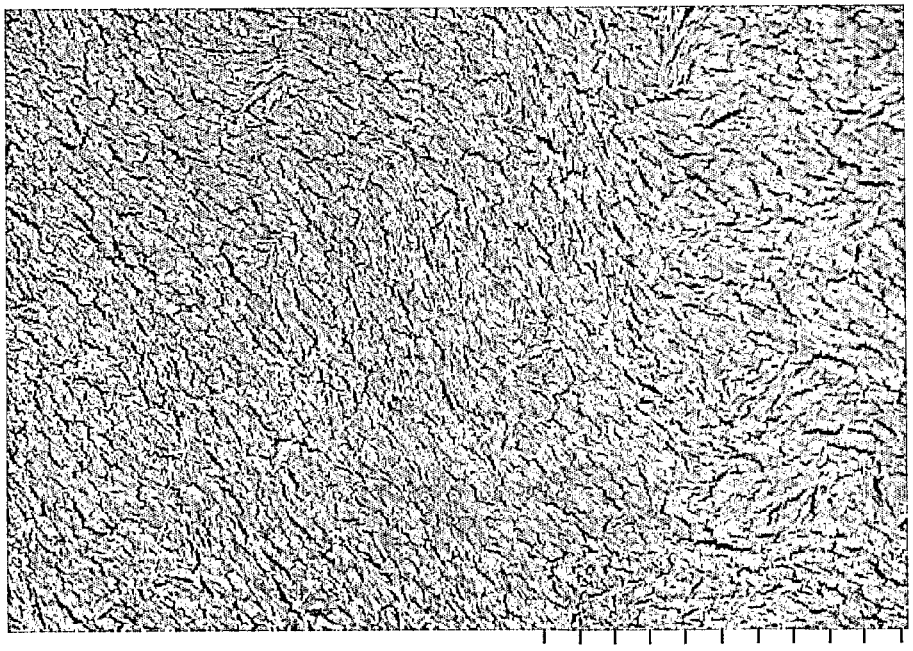
FIG. 5: is a FEG-SEM image of cellulose nano-fibril suspension after the second wash.
Figure 6:
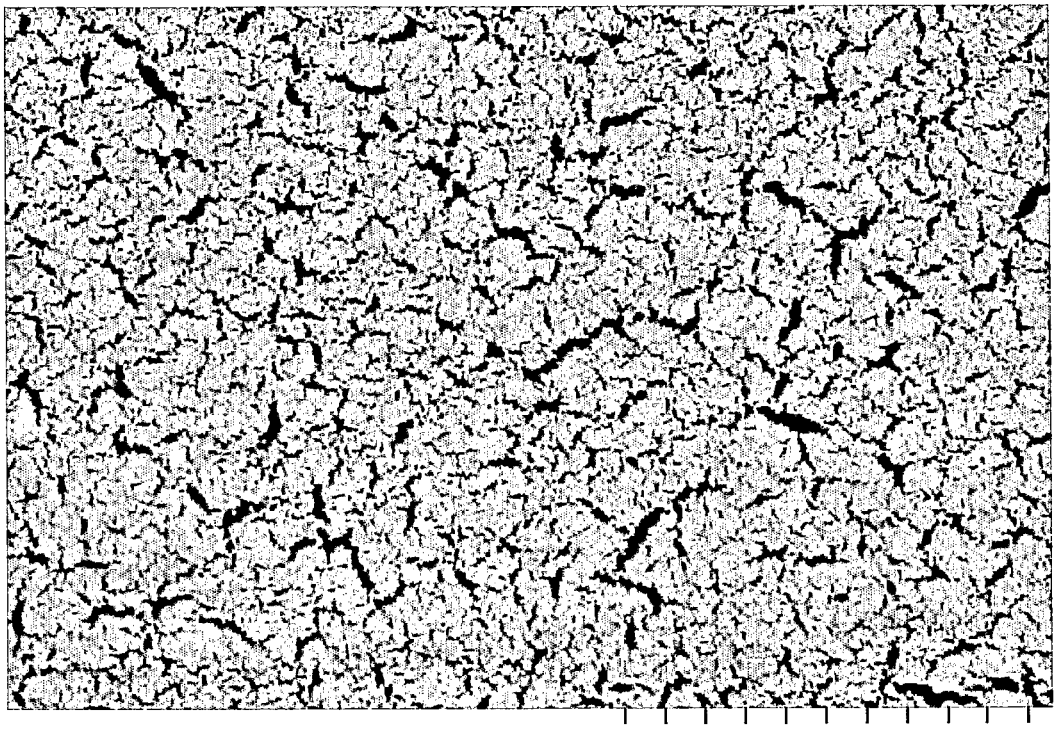
FIG. 6: is a FEG-SEM image of wash water after the second wash.

After the second wash there does not appear to be much difference in the structure of the nano-fibrils in the cellulose gel (FIG. 5) compared with the previous wash (FIG. 3). However, the image of the wash water from this centrifugation (FIG. 6) has more structure to it than in the previous wash water. This is thought of being due to the elimination of most of the amorphous cellulose in the previous wash. What is now left appears to be some of the larger debris and smaller cellulose nano-fibrils.

3$^{rd}$ Wash

Figure 7:
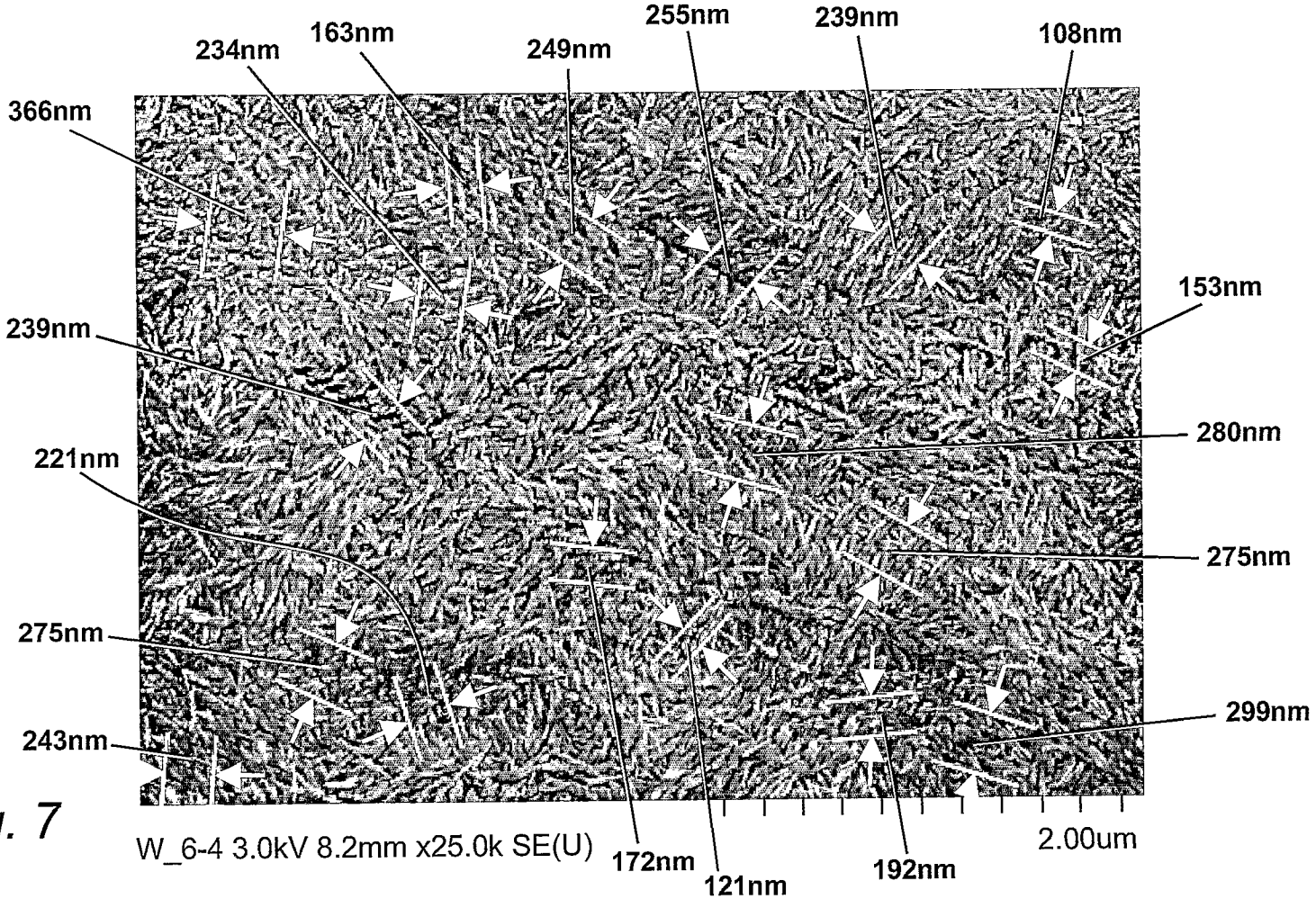
FIG. 7: is a FEG-SEM image of cellulose nano-fibril gel after the third wash.
Figure 8:
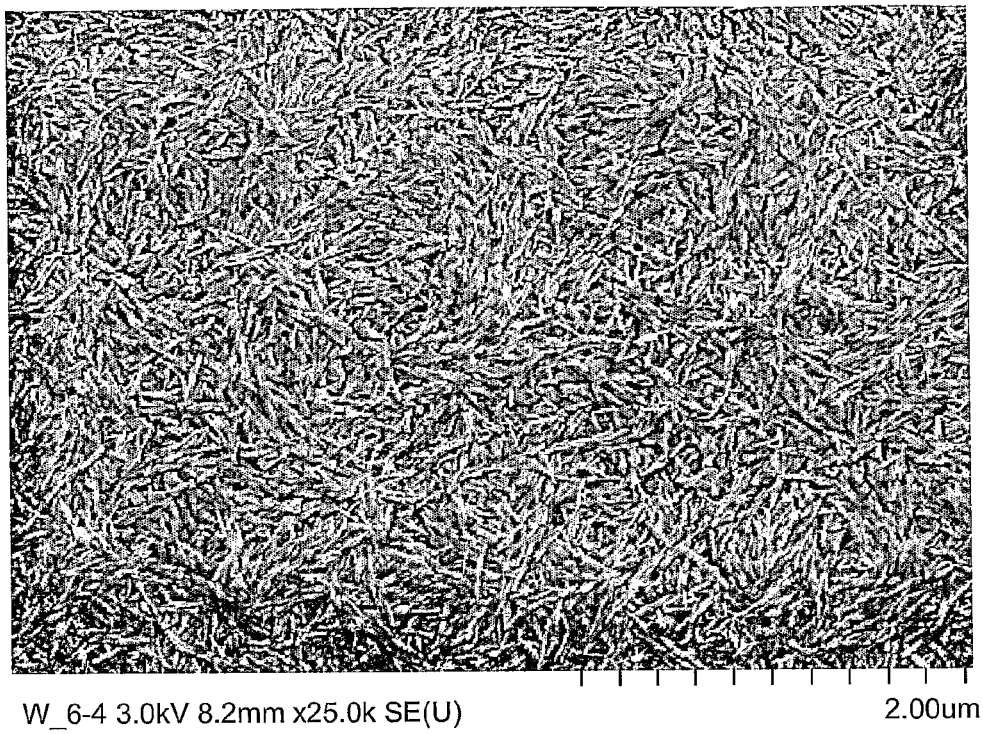
FIG. 8: is a FEG-SEM image of wash water after the third wash.

After the 3$^{rd}$ wash the cellulose nano-fibrils are easier to discriminate and the image of the gel (FIG. 7) appears to be comparable to that of the wash water seen in FIG. 8. It is clear that after the second wash the majority of the fine debris has been removed from the suspension and from hereon we are loosing the better quality nano-fibrils. Based on these observations, a decision was taken to use the cellulose nano-fibril suspension taken after the third wash for further processing into fibres.

Continued Preparation of Cellulose Nano-Fibril Suspension: Dialysis

At the end of the fourth centrifugation, the cellulose suspension is diluted again with deionised water then dialysed against deionised water using Visking dialysis tubing with a molecular weight cut-off of 12,000 to 14,000 Daltons.

Figure 20:
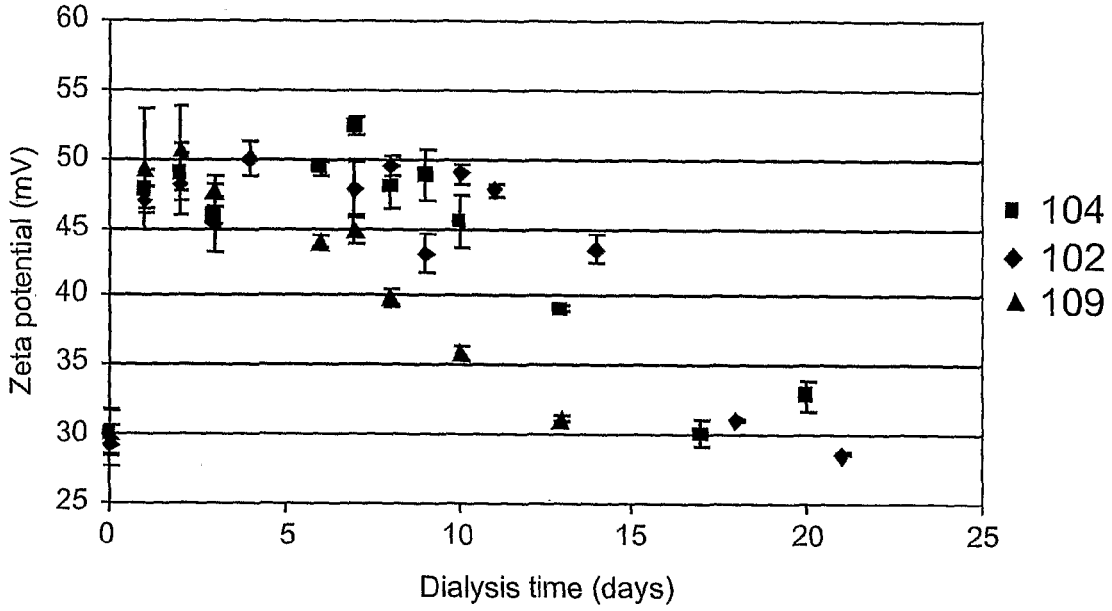
FIG. 20: is a graph showing the impact of dialysis time on the Zeta potential of cellulose nano-fibril suspensions. The graph shows absolute value also the potential is negatively charged.
Figure 21:
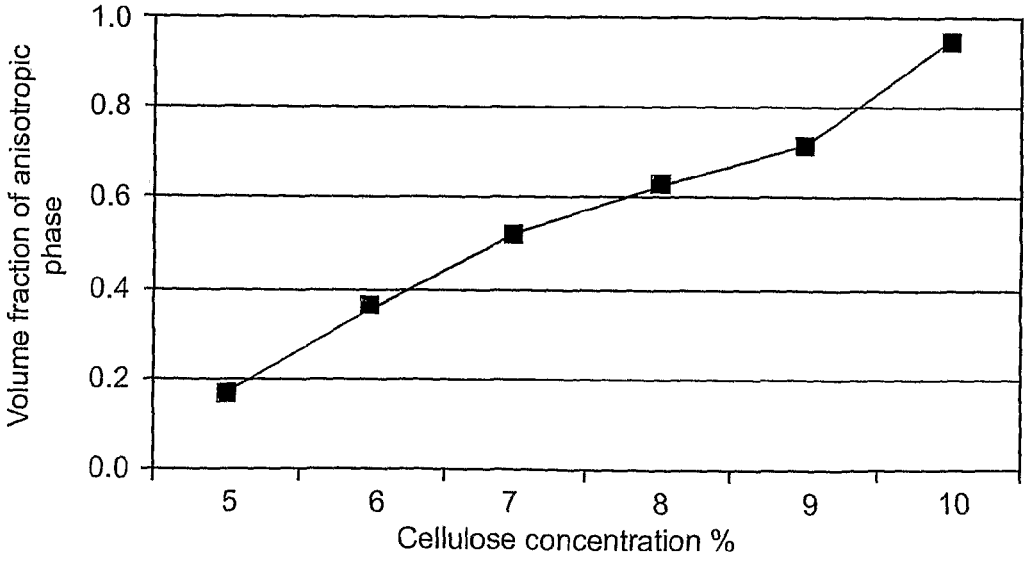
FIG. 21: is a graph showing the volume fraction of the anisotropic phase in relation to cellulose concentration of cotton based cellulose nano-fibrils after being allowed to equilibrate for 12 days.

The dialysis is used to reduce the Zeta potential of the suspension from around −50-60 mV to preferably between −30 mV and −33 mV. In running deionised water the dialysis process can take around 2-3 weeks under ambient pressure. FIG. 20 shows results of a 4-week dialysis trial in which three batches of hydrolysed cellulose nano-fibrils were analysed daily, including straight after hydrolysis with no dialysis (D0), to determine Zeta potential—using a Malvern Zetasizer Nano ZS system.

Data is the average of at least 3 readings with standard deviation shown as error bars on the graphs. The zeta potential data were consistent between batches, indicating that after 1 day of dialysis a relatively stable but short lived equilibrium is achieved at a zeta potential between −40 and −50 mV, albeit with some variance as shown by the standard deviations. After 5 to 10 days (dependent on batch) the zeta value decreases with an apparent linear trend until reaching about −30 mV after about 2 to 3 weeks of dialysis.

Pressurised dialysis equipment could be used to speed up this process. As an alternative approach to speeding up the process the suspensions can be taken out of dialysis at an earlier time (e.g. 3 days) and subsequently treated with heat (to remove some of the sulphate groups) or a counterion such as calcium chloride to reduce zeta potential to the required level.

Dialysis is particularly advantageous when sulphuric acid has been used for carrying out the hydrolysis. A Zeta potential lower than −30 mV results is an unstable suspension at high concentration with aggregation of nano-fibrils taking place which can lead to an interruption in the flow of the suspension during spinning. A Zeta potential above −35 mV leads to poor cohesion in the fibre during spinning, even at high concentrations. The low cohesion means the wet fibre flows like a low viscosity fluid, which cannot be subjected to tension and drawn down prior to drying. A process which is particularly advantageous in unwinding the chiral twist since if the fibre is fully dried under tension before the chiral twist is unwound the fibre will shrink longitudinally resulting in fibre breakage. Once the nano-fibrils are aligned with the axis of the fibre, the shrinkage will take place laterally reducing fibre diameter and increase fibre coherence and strength. The nano-fibrils will also be able to slip between each other more easily facilitating the draw down process.

Dispersion and Filtering

After dialysis, the cellulose preparations are sonicated using a hielscher UP200S ultrasonic processor with a S14 Tip for 20 minutes (in two 10 minute bursts to avoid overheating) to disperse any aggregates. The dispersed suspension is then re-centrifuged to produce the concentrated, high viscosity suspension required for spinning.

In the first example of spinning the cellulose nano-fibril gel was concentrated to 20% solids using the centrifuge. In the second example the concentration was increased to 40% to increase wet gel strength.

EXAMPLE 3

Spinning of a Crystallised Fibre on a Hot Drum

Figure 9:
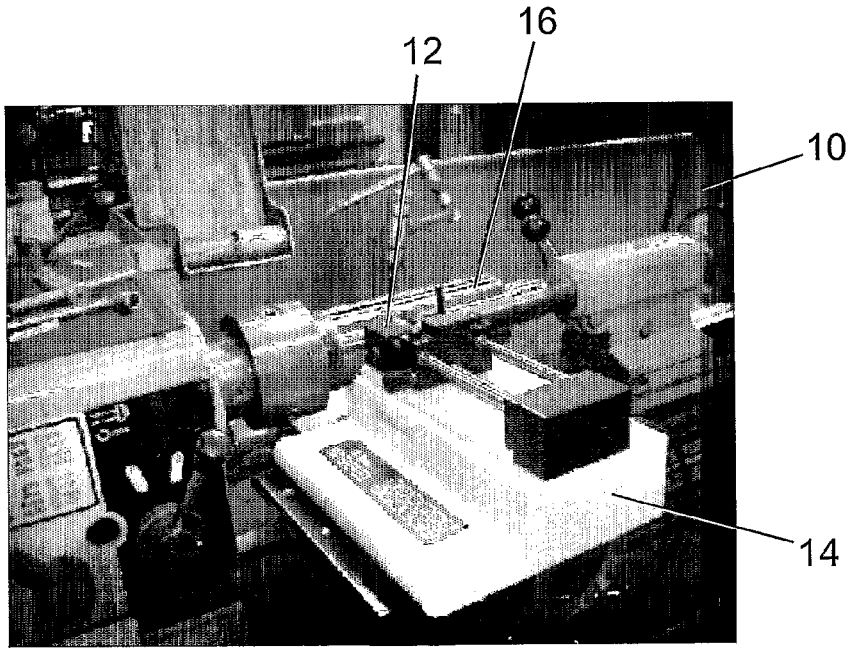
FIG. 9: is a picture of a device used in example 3 for the spinning of the fibre.

The first spinning example involved the use of the apparatus (10) shown in FIG. 9 where the cellulose nano-fibril gel is extruded from a syringe (12) with a 240-micron needle diameter. The injection process was controlled by a syringe pump (14) attached to a lathe. The fibre extruded from the syringe was injected onto a polished drum (16) capable of rotating at up to 1600 rpm. The drum 16 was heated at approximately 100° C. Using the automated syringe pump (14) and rotating heated drum (16) permitted well-defined, controlled flow rates and draw down ratios (DDR).

Figure 10:
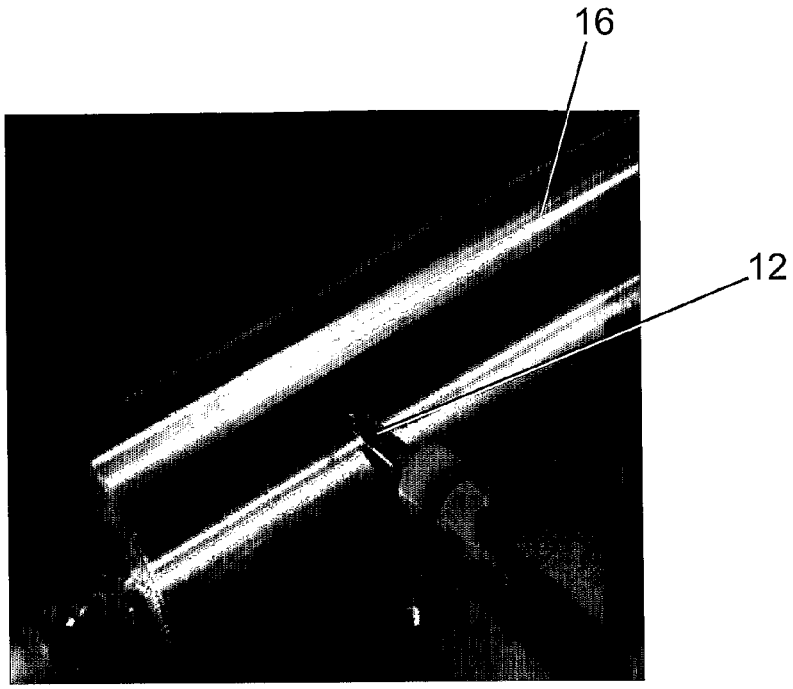
FIG. 10: is a close up picture of FIG. 9 showing respective positioning of the needle and the heated drum.

As better shown in FIG. 10 the needle of the syringe (12) is almost in contact with the heated drum (16) onto which the cellulose fibres are injected whilst the drum is rotating, thus achieving a small air gap. The heated drum (16) provides rapid drying of the fibres which allows the fibre to stretch under tension leading to extensional alignment and unwinding of the chiral nematic structure of the cellulose nano-fibrils.

Figure 11:
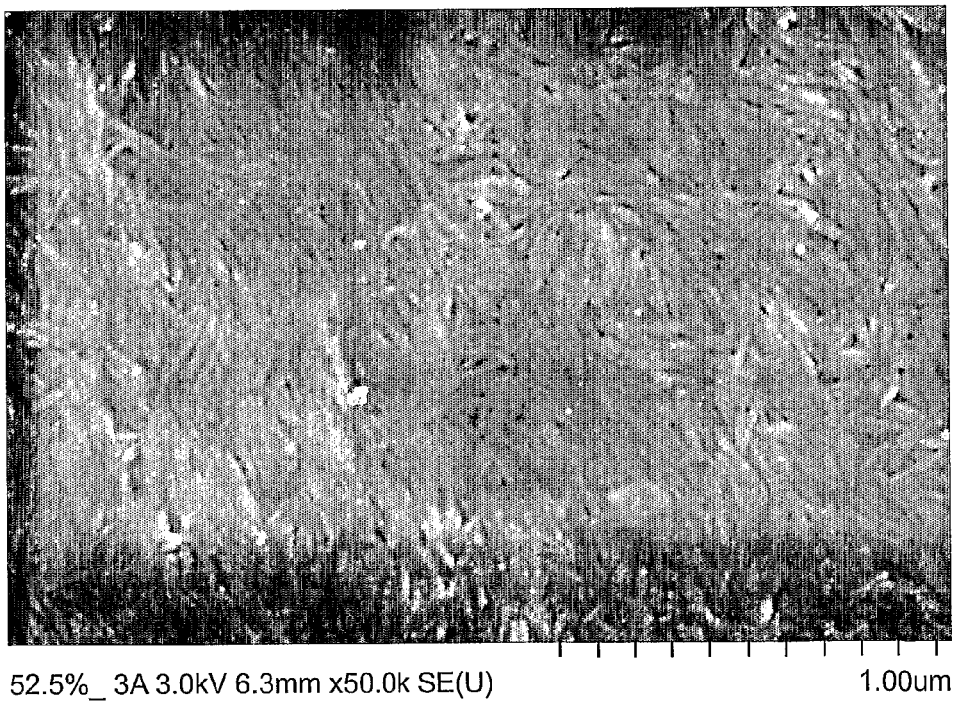
FIG. 11: is a FEG-SEM image at 50 000× of a fibre spun using a low DDR.

When a fibre is spun without draw down, FIG. 11 shows that fibril alignment on the fibre surface is more or less random.

Spinning of fibres at significantly higher DDR allows better fibril alignment and thinner fibres. Table 1 below outlines details of two rates of flow that were used to successfully align fibres. The table also gives predicted fibre diameters which were almost exactly what was achieved. Manual handling of the fibres also indicated clear improvements in fibre strength with increasing draw down ratio. As predicted, the fibre diameter decreased with increasing draw down ratio.

TABLE 1

| Delivery rate of syringe (ml/min) | Exit speed from needle with ID of 0.2 mm (m/min) | Take up speed for our take up drum rotating at 1600 rpm (m/min) | DDR | Predicted fibre diameter (μ) |
|---|---|---|---|---|
| 6.4 | 204 | 437 | 2.15 | 93 |
| 3.2 | 102 | 437 | 4.29 | 46 |

Figure 12:
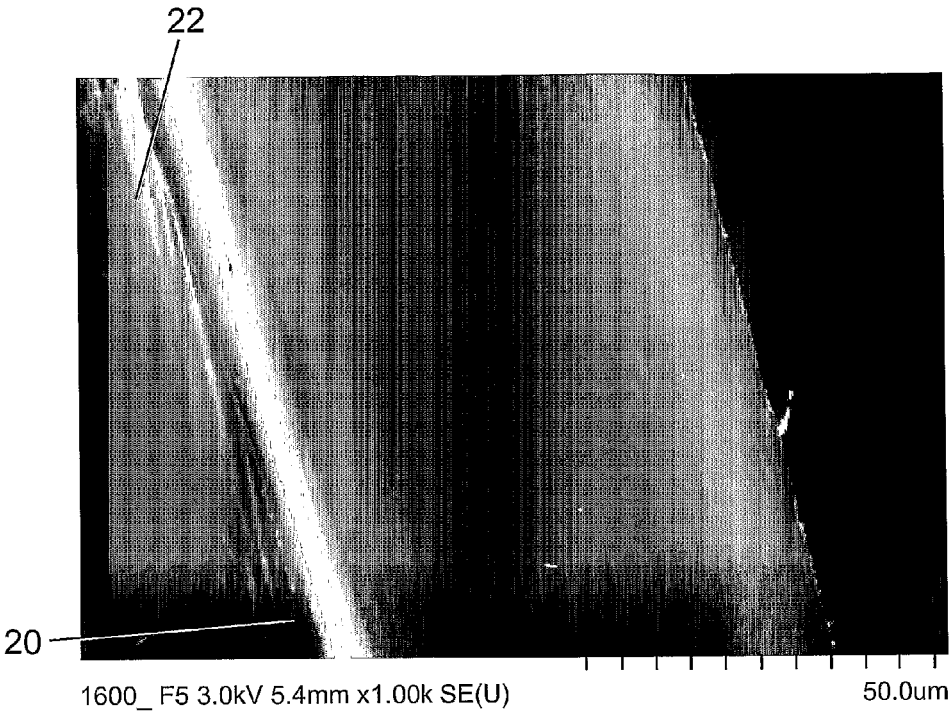
FIG. 12: is a low magnification image of 40 micron spun fibre (1000× mag) according to the invention.
Figure 13:
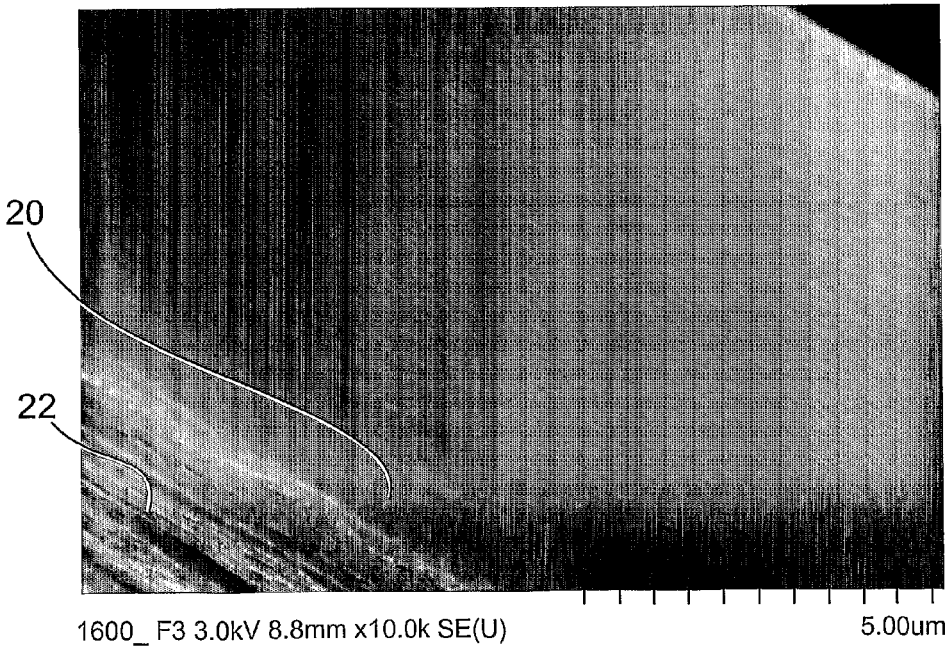
FIG. 13: is a FEG-SEM image of a 40 micron spun fibre according to the invention
Figure 14:
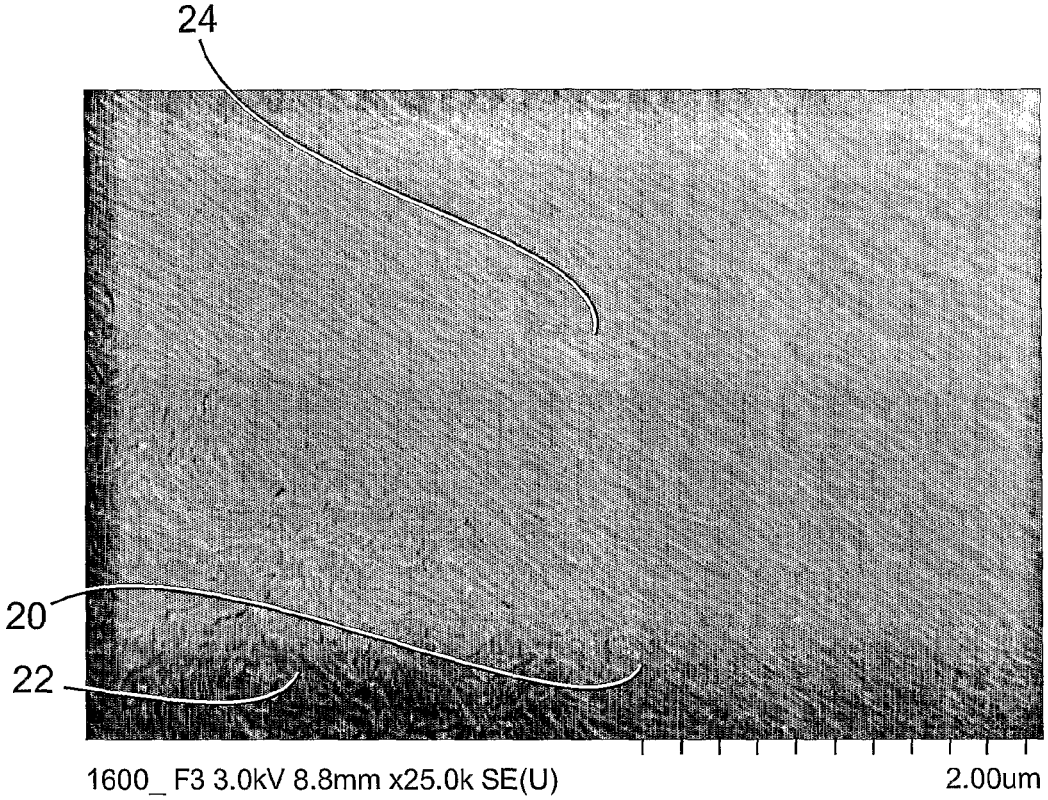
FIG. 14: is an enlargement of the image shown in FIG. 13 (FEG-SEM image at 50 000×).

Under the faster drawing conditions, good fibril alignment was observed with the better draw down ratio. FIG. 12 shows the top side of such a 40μ fibre at a magnification of 1000× and FIG. 13 shows a FEG-SEM image of this fibre obtained with a DDR of about 4.29. The bottom left edge (20) of the fibre was in contact with the heated drum (16). Adjacent to this it is possible to see the turbulent flow of fibrils (22). The top right of the image is not completely in focus. However, it is possible to see the linear flow (nematic alignment) of the fibrils. FIG. 14 shows an enlargement of the first image on the boundaries between the turbulent (22) and linear flow (24).

To remove the irregularities associated with the drying by contact with the drum a different spinning facility is used in the subsequent example.

Figure 15:
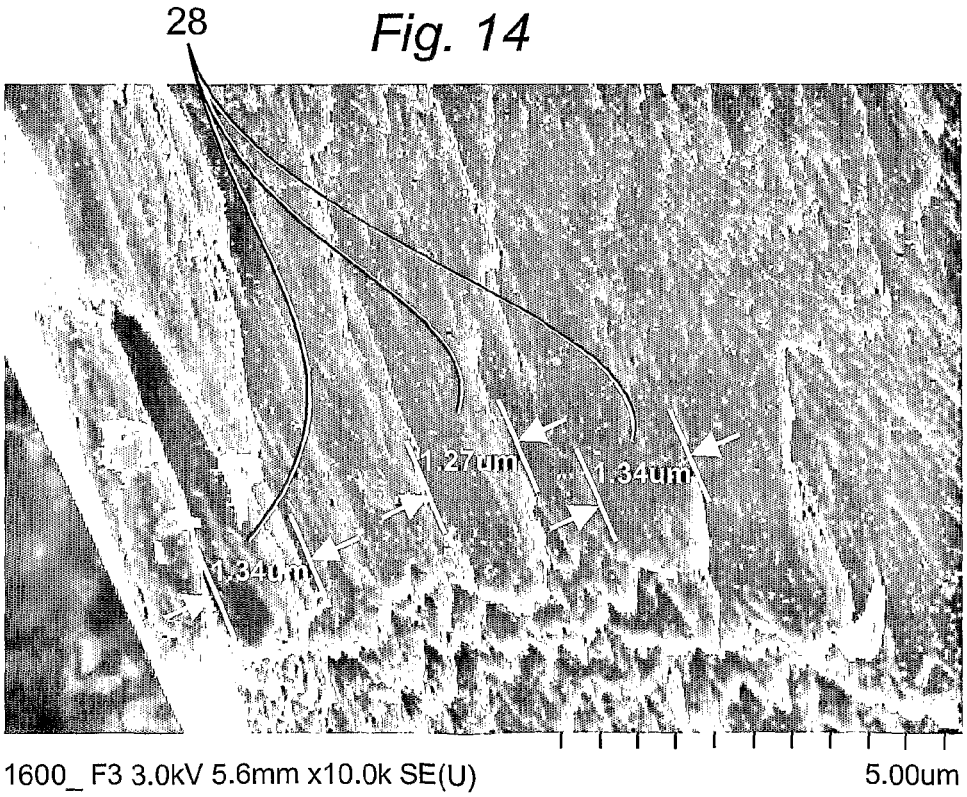
FIG. 15: is an image at 50 000× magnification showing a fibre according to the invention which is fractured.

FIG. 15 shows a fractured "40μ" fibre. It is clear from this image that the nano-fibrils are oriented in a nematic structure. The image demonstrates that stretching of the fibre prior to drying can successfully orient the nano-fibrils. The fibres are not fracturing at the individual nano-fibril level but at an aggregated level. The aggregates are often in excess of 1 micron (see FIG. 15 showing aggregates (28) of 1.34 and 1.27 microns). This aggregation is occurring as the nano-fibrils fuse together under the elevated temperature conditions.

Figure 16:
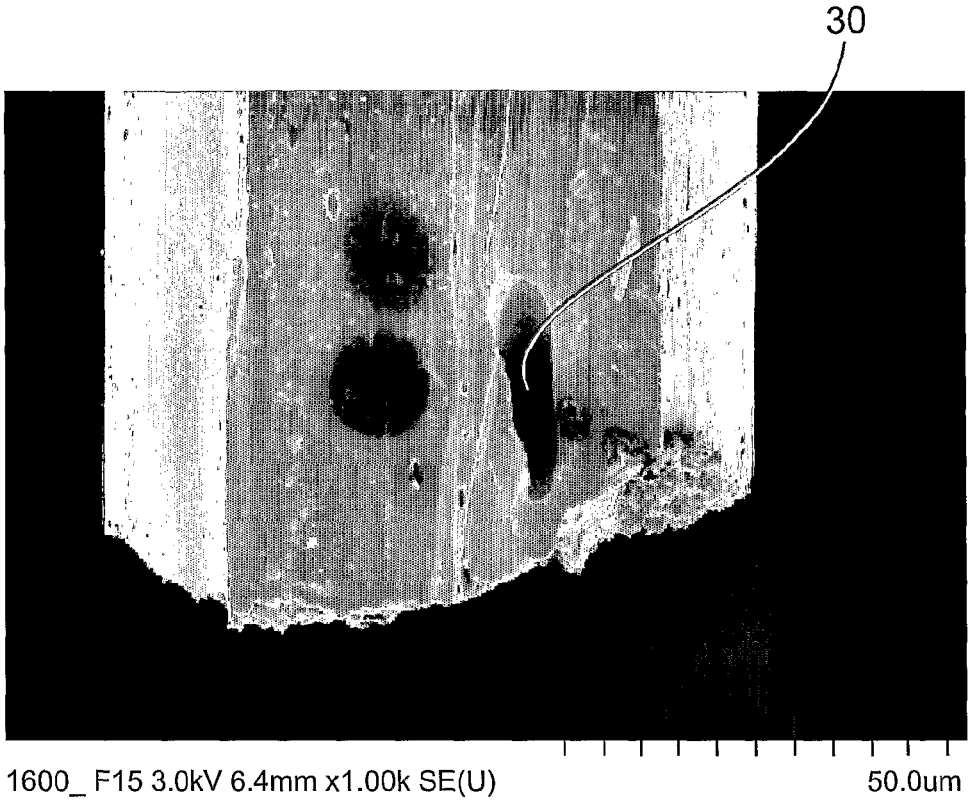
FIG. 16: is an image of the underside of one of the fibres spun at the DDR according to the invention.

FIG. 16 shows the underside of one of the fibres spun at the higher draw down ratio. It can be seen from the image that the fibre is not completely cylindrical as it is spun onto a flat drum. The drum was visibly smooth, however, at the micron level it does have some roughness which led to cavities (30) on the underside of the fibre as it dried. These cavities (30) will have a big impact on the strength of the fibre and this cavitation process would lead to lower strength fibres.

An alternative approach in which the fibre exiting from the die is allowed to dry without contact with the sort of drum that we used is given in a second spinning process described in example 4 herein below.

EXAMPLE 4

Figure 17A:
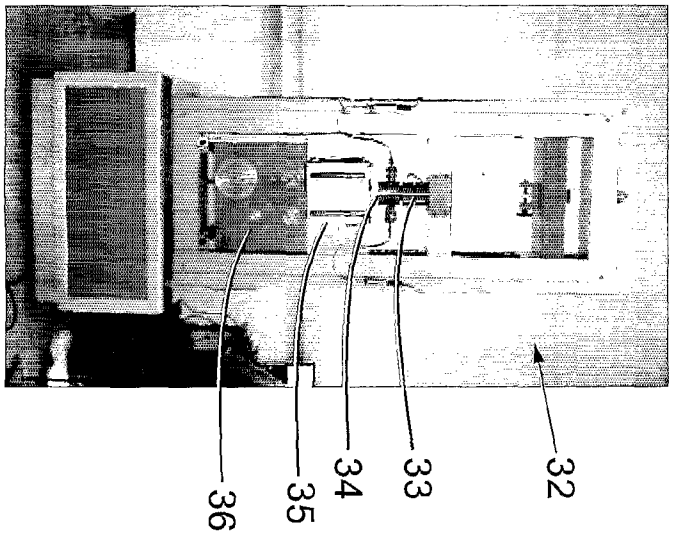
FIGS. 17*a* and 17*b*: is a picture of spin line rheometer used in example 4
Figure 17B:
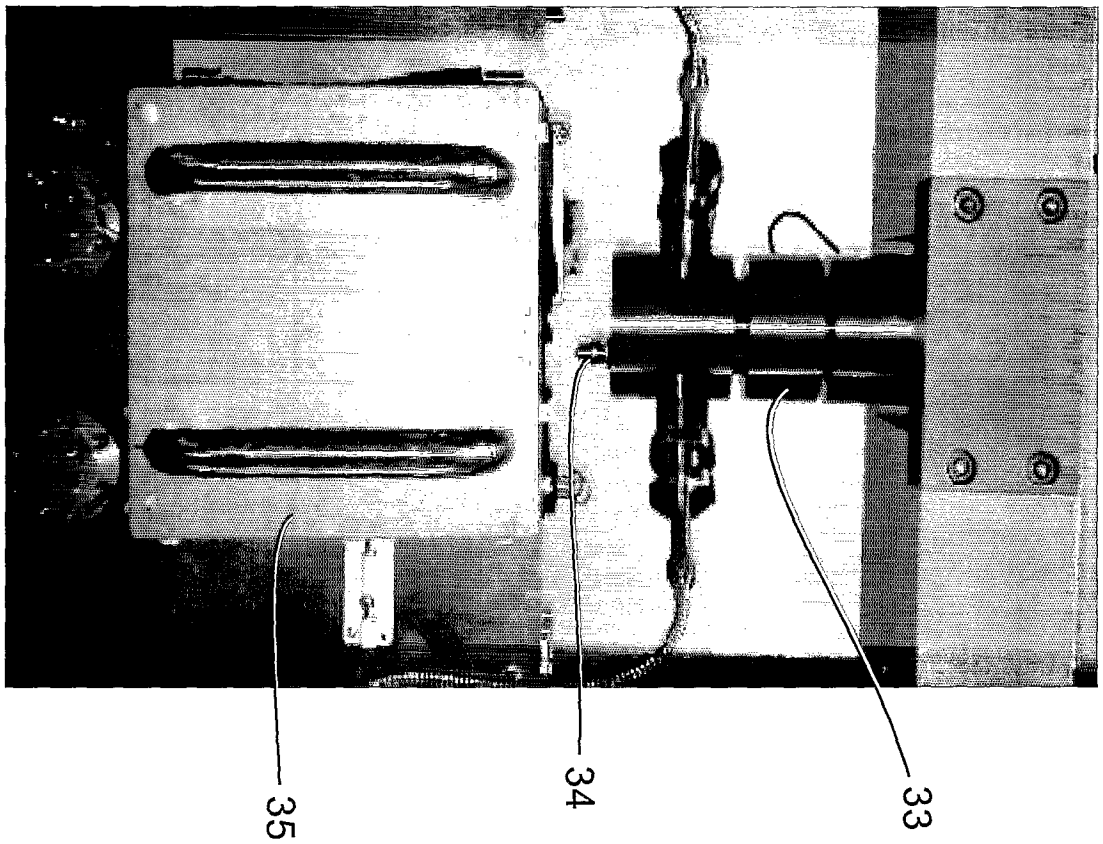

The second spinning example involves the use of a Spin line rheometer (32) which is shown in FIGS. 17*a* & 17*b*. This rheometer (32) comprises a barrel (33), which contains the cellulose suspension and communicates with a die (34). The extruded fibre is passed though a drying chamber (35) and is dried therein using a flow of hot air before being captured on the take up wheel (36).

The key differences between this spinning process and the one of the previous example are the following:

The fibre extrusion process is more precisely controlled

Figure 18:
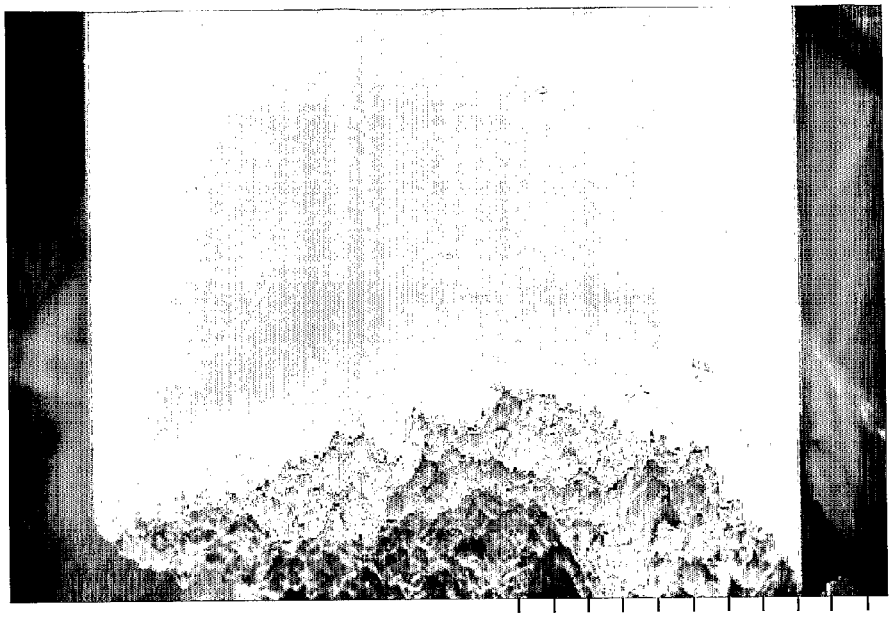
FIG. 18: is an image of a fibre spun using the spin line rheometer of FIG. 17*a*.

The fibre once extruded is dried with hot air rather than on a heated drum allowing for the production of a perfect cylindrical fibre. FIG. 18 shows an image of the smooth surface of a 100 micron fibre that was spun from a 250 micron needle (1000× magnification) using the Rheometer of FIG. 17*a*.

Because the fibre is air dried, a substantially larger air gap is required to allow for fibre drying before subsequent collection on a take up wheel which provides the draw down (stretch) to the fibre. Before spinning at high speed can take place, a "wet" leader fibre has to be drawn from the die and attached to the take up reel. The take up reel and the feed speed from the die are then ramped up to a point where we can achieve the draw down ratio that is needed to stretch the fibre and get extensional alignment of the fibrils. This draw down leads to a thinning of the fibre from the initial die or needle diameter (in this case 240 microns) to whatever fibre thickness is required. Ideally the thinner the fibre the less potential defects which will lead to higher strength. A fibre having a diameter of 5 microns has a very high surface area to volume ratio, which allows rapid heat transfer and drying and would therefore be provided with high strength.

This larger air gap means that the wet strength of the nano-fibril suspension must be much higher than in the previous example. To obtain the higher wet strength the solids content in the suspension had to be increased from 20% to 40% resulting in a much higher viscosity.

In the example given, once the nano-fibril suspension had been concentrated to around 40% solids (by centrifuging the cellulose suspension for 24 hours at 11000 rpm) it was decanted into a syringe which was then centrifuged at 5000 rpm for 10-20 minutes to remove air pockets. The gel was then injected into the Rheometer bore as a single plug to prevent further air cavities being formed. Air pockets in the gel may lead to a break in fibre during spinning and should be avoided. The DDR used in this example was fairly low at around 1.5 and an even better alignment should result from higher DDR.

Figure 19:
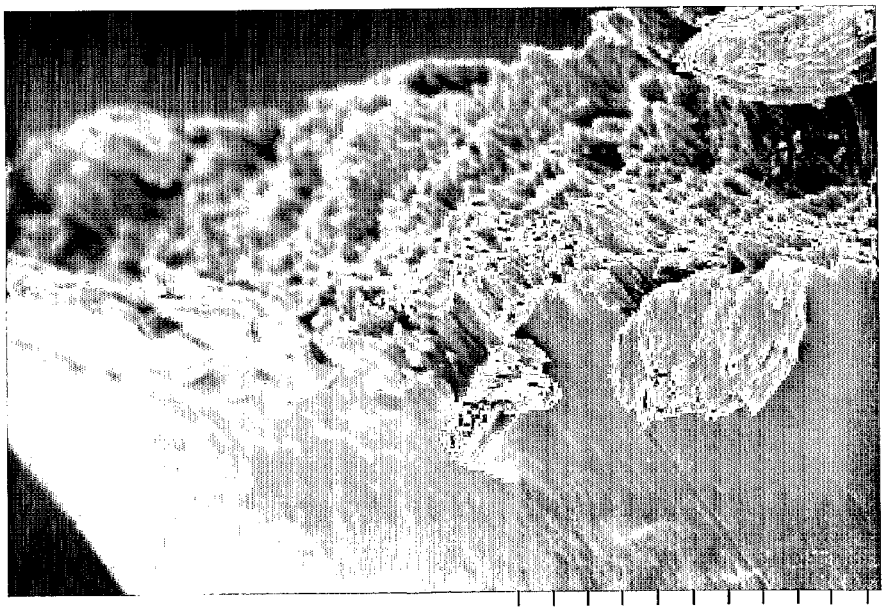
FIG. 19: is an enlargement of the image of FIG. 18 showing the orientation of nano fibrils on fibre surface and at the fibre fracture point.

FIG. 19 is a close up of FIG. 18 and shows that the nano-fibrils in the fracture are aligned along the axis of the fibre. A close examination reveals that the nano-fibrils on the surface of the fibre are also oriented along the fibre axis.

Figure 22:
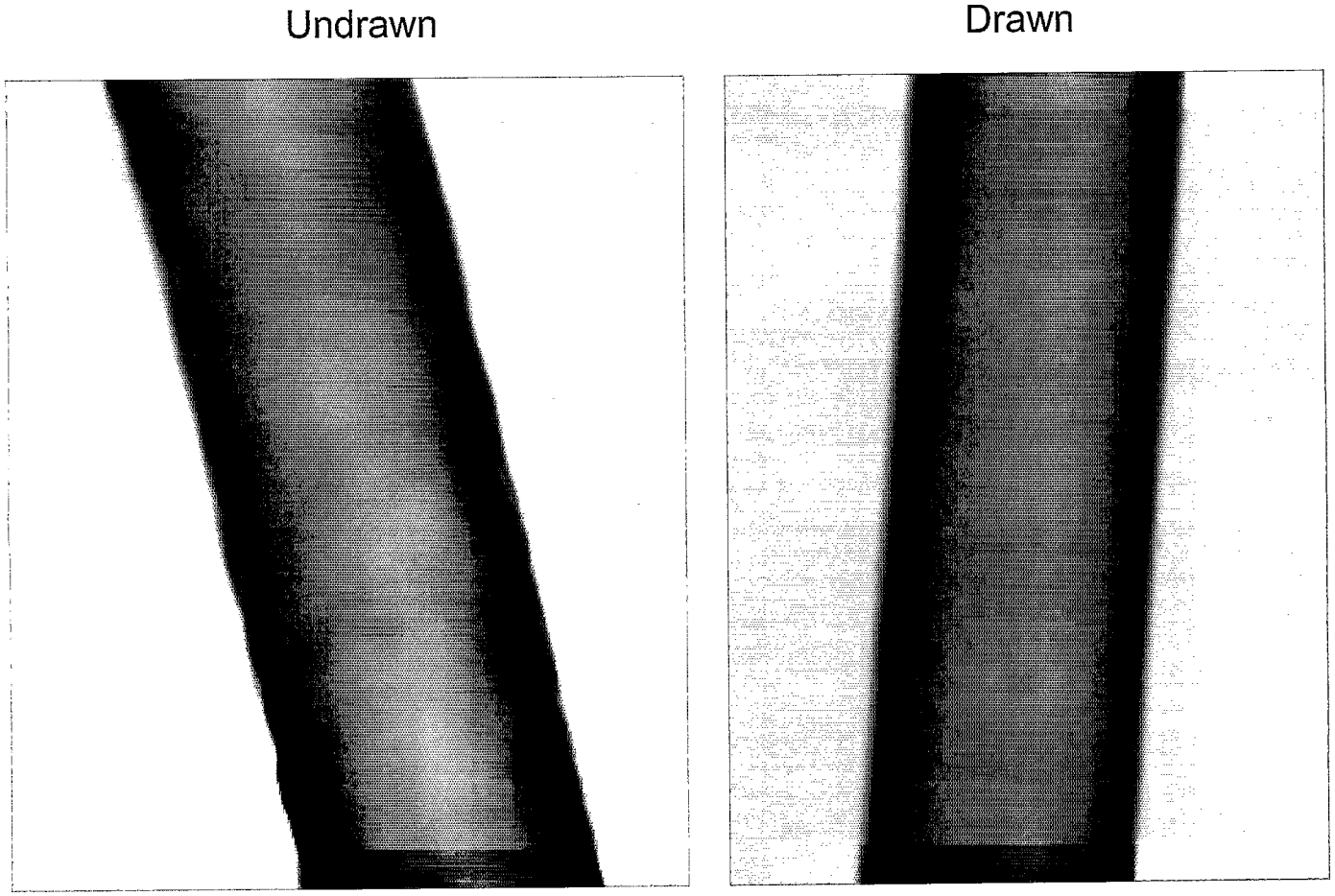
FIG. 22: A comparison of polarizing light microscopy images of drawn and undrawn fibres at 200× magnification. Increased birefringence can be seen in the drawn fibre indicating the more aligned structure. The rough surface texture of the undrawn fibre is due to twisted (chiral) domains, which are permanent part of the structure of the fibre once it has been dried.

For illustrative purposes, FIG. 22 shows polarizing light microscopy images of drawn and undrawn fibres at 200× magnification. The undrawn fibre has a rough surface compared to the drawn fibre. The rough surface of the undrawn fibre is caused by the periodic twisted domains caused as a result of the chiral twist. The nano-fibrils aggregate together in twisted structures at the micro meter scale during drying. During the draw down process the chiral twist is unwound leading to a smooth surface. Other modifications would be apparent to the persons skilled in the art and are deemed to fall within the broad scope and ambit of the invention. In particular the DDR can be increased to improve alignment of nano-fibrils even further and reduce fibre diameter. This will assist in minimising defects and increase aggregation of nano-fibrils into larger aggregates. Also hyperbolic dies can be designed taking account of the rheology of the cellulose suspension to be spun. The design of such dies is well documented in the public domain as a mechanism for aligning other liquid crystal solutions such as that used in Lyocell.

The invention claimed is:

1. A method for the spinning of a continuous fibre comprising:

extruding the fibre from a die, spinneret or needle;

aligning cellulose nano-fibrils along a main axis of the fibre from a lyotropic suspension of cellulose nano-fibrils, said nano-fibril alignment being achieved through extension of the extruded fibre from the die, spinneret or needle, drying said fibre under extension, and aggregating the aligned nano-fibrils to form a continuous fibre.

2. The method according to claim 1, wherein said cellulose nano-fibrils are extracted from a cellulose rich material.

3. The method according to claim 1, wherein said suspension is water based.

4. The method according to claim 1, wherein said method comprises an extraction step which comprises the hydrolysis of a cellulose source with an acid.

5. The method of claim 4, wherein said extraction step comprises at least one washing step.

6. The method of claim 5, wherein said extraction step comprises at least one separating step to remove fibrilar debris subsequent to, or instead of, said washing step and which is carried out by centrifugation or phase separation.

7. The method of claim 1, wherein said suspension is homogenised before spinning to disperse aggregates.

8. The method of claim 1, wherein said suspension contains cellulose nano-fibrils with an average zeta potential ranging from −20 mV to −60 mV.

9. The method of claim 1, wherein said suspension contains cellulose nano-fibrils with an average zeta potential ranging from −30 mV and −35 mV.

10. The method of claim 1, wherein said suspension comprises a level of concentrated solids ranging from 10 to 60% wt.

11. The method of claim 1, wherein the draw down ratio of said spinning method is superior to 1.2.

12. The method according to claim 11, wherein said draw down ratio is chosen to be the range of 2 to 20.

13. The method according to claim 1, wherein said method comprises the spinning of said suspension into a fibre and wherein said extruded fibre is substantially dried during spinning.

14. The method according to claim 1 wherein alignment of said nano-fibrils is improved by the use of a hyperbolic die designed to match the rheological properties of the suspension.

15. The method of claim 1, wherein said suspension is a concentrated high viscosity suspension.

16. The method according to claim 1, wherein said cellulose rich material comprises at least one of wood pulp and cotton.

17. The method according to claim 1, wherein said acid comprises sulphuric acid.

18. The method of claim 17, wherein said extraction step comprises at least one washing step.

19. The method of claim 18, wherein said extraction step comprises at least one separating step to remove fibrilar debris subsequent to, or instead of, said washing step and which is carried out by centrifugation or phase separation.

* * * * *